US009661917B2

(12) United States Patent
Dias

(10) Patent No.: US 9,661,917 B2
(45) Date of Patent: May 30, 2017

(54) RAIL MOUNTED TABLE DEVICE

(71) Applicant: Mary S. Dias, Fairfax, VA (US)

(72) Inventor: Mary S. Dias, Fairfax, VA (US)

( * ) Notice: Subject to any disclaimer, the term of this patent is extended or adjusted under 35 U.S.C. 154(b) by 0 days.

(21) Appl. No.: 14/799,713

(22) Filed: Jul. 15, 2015

(65) Prior Publication Data

US 2016/0113390 A1 Apr. 28, 2016

Related U.S. Application Data

(60) Provisional application No. 62/068,120, filed on Oct. 24, 2014.

(51) Int. Cl.

| | |
|---|---|
| ***A47B 37/00*** | (2006.01) |
| ***A47B 13/00*** | (2006.01) |
| ***A47B 5/02*** | (2006.01) |

(52) U.S. Cl.

CPC ..... *A47B 13/003* (2013.01); *A47B 5/02* (2013.01)

(58) Field of Classification Search

CPC ..... A47B 96/022; A47B 23/02; F16M 13/02
USPC ..... 108/42, 47, 48; 211/86.01; 248/220.1
See application file for complete search history.

(56) References Cited

U.S. PATENT DOCUMENTS 1,922,935 A * 8/1933 Du Bois ..... A47B 96/062 248/220.1
2,691,237 A * 10/1954 Heim ..... A47J 47/20 211/86.01
2,911,176 A * 11/1959 Roediger ..... A47H 1/022 248/220.1
3,295,470 A * 1/1967 Johnson ..... A47K 3/004 108/47
3,338,628 A * 8/1967 Evans ..... A61G 5/10 108/47
4,893,363 A 1/1990 Huff
5,240,214 A * 8/1993 Birnbaum ..... A47B 88/044 248/214
5,368,266 A * 11/1994 Allen ..... E04H 13/003 108/47
5,528,993 A 6/1996 Vincelli
5,653,178 A 8/1997 Huczka
6,079,336 A 6/2000 Lindstrom
6,931,998 B1 * 8/2005 Leese ..... A47B 5/02 108/42
7,121,213 B2 * 10/2006 Viazanko ..... A47B 13/08 108/42

(Continued)

*Primary Examiner* — Jose V Chen
(74) *Attorney, Agent, or Firm* — Global Intellectual Property Agency, LLC; Daniel Boudwin

(57) ABSTRACT

A rail mounted table device for securing onto a rail and placing objects thereon. The rail mounted table device includes a planar member having an upper surface and a lower surface, wherein a pair of protrusions extend perpendicularly from the lower surface of thereof. The protrusions define a channel in order to accept a horizontal rail therebetween, allowing the lower surface of the planar member to rest flush against the upper surface of a rail. The protrusions are preferably rectangular, wherein the first protrusion is parallel to the second protrusion. In this way, the rail mounted table device is removably securable to a rail. In an alternative embodiment, each protrusion is L-shaped so as to fit over a corner of a rail. The upper surface of the planar member provides an area for users to rest objects thereon, such as food and drinks.

7 Claims, 3 Drawing Sheets

(56) References Cited

U.S. PATENT DOCUMENTS

| | | | | |
|---|---|---|---|---|
| 7,533,618 | B2 * | 5/2009 | Thomason | A47B 7/00 108/42 |
| 8,141,830 | B1 * | 3/2012 | Hudson | E04G 21/1808 248/220.1 |
| 8,561,550 | B2 | 10/2013 | Raml | |
| 2009/0000523 | A1 * | 1/2009 | Ciardelli | A47B 37/04 108/42 |
| 2015/0164224 | A1 * | 6/2015 | Kemp | A47B 96/02 108/42 |

* cited by examiner

RAIL MOUNTED TABLE DEVICE

CROSS REFERENCE TO RELATED APPLICATION

This application claims the benefit of U.S. Provisional Application No. 62/068,120 filed on Oct. 24, 2014. The above identified patent application is herein incorporated by reference in its entirety to provide continuity of disclosure.

BACKGROUND OF THE INVENTION

Field of the Invention

The present invention relates to rail mounted table devices. More specifically, the present invention provides a planar member having an upper surface and a lower surface, wherein a pair of protrusions extend perpendicularly from the lower surface of the planar member. The protrusions define a channel in order to accept the top of a horizontal rail therebetween, allowing the lower surface of the planar member to rest flush against the upper surface of a rail. The protrusions are preferably rectangular, wherein the first protrusion is parallel to the second protrusion. In this way, the rail mounted table device is adapted to removably secure to a horizontal rail. In an alternative embodiment, each protrusion is L-shaped so as to fit over a corner of a rail.

Many social gatherings take place on a balcony or deck. Individuals attending these gathering often place food and drinks on the rail of the balcony or deck. However, due to the narrowness of such rails, any food or drink placed thereon is in a position to be easily knocked off by the slightest bump to the rail. It is inconvenient to stop socializing at a gathering in order to clean up a mess. Other individuals choose to simply hold their food and drinks if there is a lack of table space, which is inconvenient and uncomfortable. These individuals are unable to engage in other party activities, such as games, if their hands are occupied by holding food and drink. Furthermore, it is difficult and awkward to eat and drink while holding the plate and cup an individual is eating from, especially if required to use a fork and knife. Additionally, many decks and balconies do not have enough space to enable a table to be placed thereon. Therefore, there is a need in the prior art for a convenient means for providing additional support surfaces for decks, balconies, and the like.

Devices have been disclosed in the prior art that relate to rail mounted table devices. These include devices that have been patented and published in patent application publications. These devices generally relate to a table top that fastens to the vertical slats that support a rail. These devices include U.S. Pat. No. 8,561,550 to Raml and U.S. Pat. No. 5,528,993 to Vincelli. Another device, U.S. Pat. No. 6,079,336 to Lindstrom, relates to a table top that attaches to a corner of a rail by a fastener, such as a screw. Other devices, such as U.S. Pat. No. 5,653,178 to Huczka and U.S. Pat. No. 4,893,363, generally relate to a table top that folds down or suspends from a rail or side of an above ground pool by a U-shaped lip. These devices, however, fail to disclose a planar member having a first protrusion and a second protrusion extending perpendicularly from the lower surface of the planar member, wherein the device is adapted to be positioned over a rail. Furthermore, unlike the prior art, the rail mounted table device does not require hardware or fasteners to removably secure the device to a rail.

In light of the devices disclosed in the prior art, it is submitted that the present invention substantially diverges in design elements from the prior art and consequently it is clear that there is a need in the art for an improvement to existing rail mounted table devices. In this regard the instant invention substantially fulfills these needs.

SUMMARY OF THE INVENTION

In view of the foregoing disadvantages inherent in the known types of rail mounted table devices now present in the prior art, the present invention provides a new rail mounted table device wherein the same can be utilized for providing convenience for the user when providing storage space on a rail.

It is therefore an object of the present invention to provide a new and improved rail mounted table device that has all of the advantages of the prior art and none of the disadvantages.

It is another object of the present invention to provide a rail mounted table device comprising a circular planar member having a pair of protrusions extending perpendicularly from the lower surface of the planar member, wherein the protrusions define a channel therebetween adapted to accept a horizontal rail.

Another object of the present invention is to provide a rail mounted table device wherein the pair of protrusions are rectangular and parallel to each other.

Yet another object of the present invention is to provide a rail mounted table device wherein an alternative embodiment, includes a pair of protrusions each having an L-shaped configuration adapted to accept a corner of a rail therebetween.

Another object of the present invention is to provide a rail mounted table device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
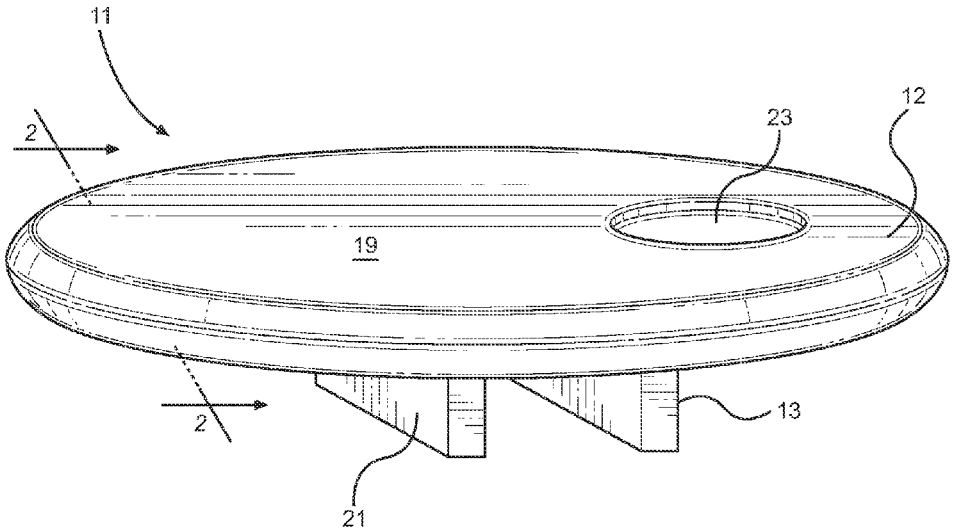
FIG. 1 shows a perspective view of an embodiment of the rail mounted table device.

Reference is made herein to the attached drawings. Like reference numerals are used throughout the drawings to depict like or similar elements of the rail mounted table device. For the purposes of presenting a brief and clear description of the present invention, the preferred embodiment will be discussed as used for mounting onto a rail and placing objects thereon. The figures are intended for representative purposes only and should not be considered to be limiting in any respect.

Figure 2:
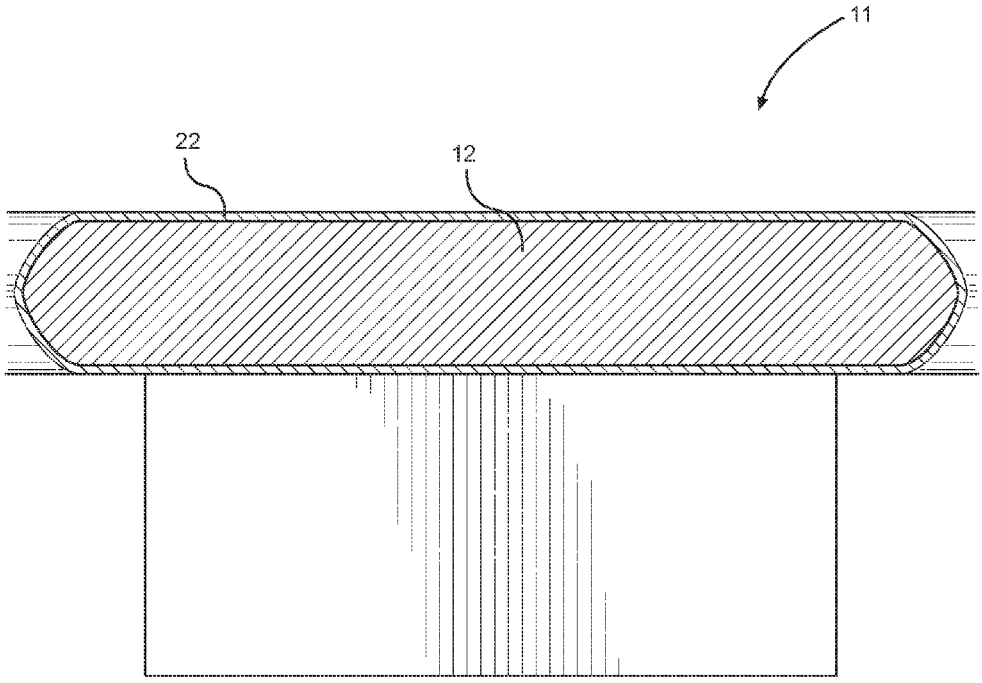
FIG. 2 shows a cross sectional view of the rail mounted table device.

Referring now to FIGS. 1 and 2, there is shown a perspective view of an embodiment of the rail mounted table device and a cross sectional view of the rail mounted table device, respectively. The rail mounted table device 11 comprises a planar member 12 having an upper surface 19 and a lower surface 18. The upper surface 19 is flat so objects placed on the planar member 12 rest flush thereon, such as food and drinks. The planar member 12 is preferably circular and includes rounded edges. In this way, there are no sharp edges on the planar member 12, thereby providing a table top design that is both aesthetically pleasing and safe to have nearby when engaging in outdoor activities at social gatherings, such as playing a game. However, in other embodiments, the planar member 12 can be any suitable shape, and can be configured as an oval, square, or rectangle. In some embodiments, the rail mounted table device 11 is provided with an exterior layer 22 in order to provide a smooth finish and to protect the device 11 from exposure to outdoor elements, such as precipitation. The planar member 12 can be composed of any suitable material, such as plastic or wood. The planar member 12 includes one or more recessed areas 23 on the upper surface 19 adapted to provide a holder for drinks, food, or the like. The recessed areas 23 can be any suitable shape, such as circular or rectangular.

Figure 3:
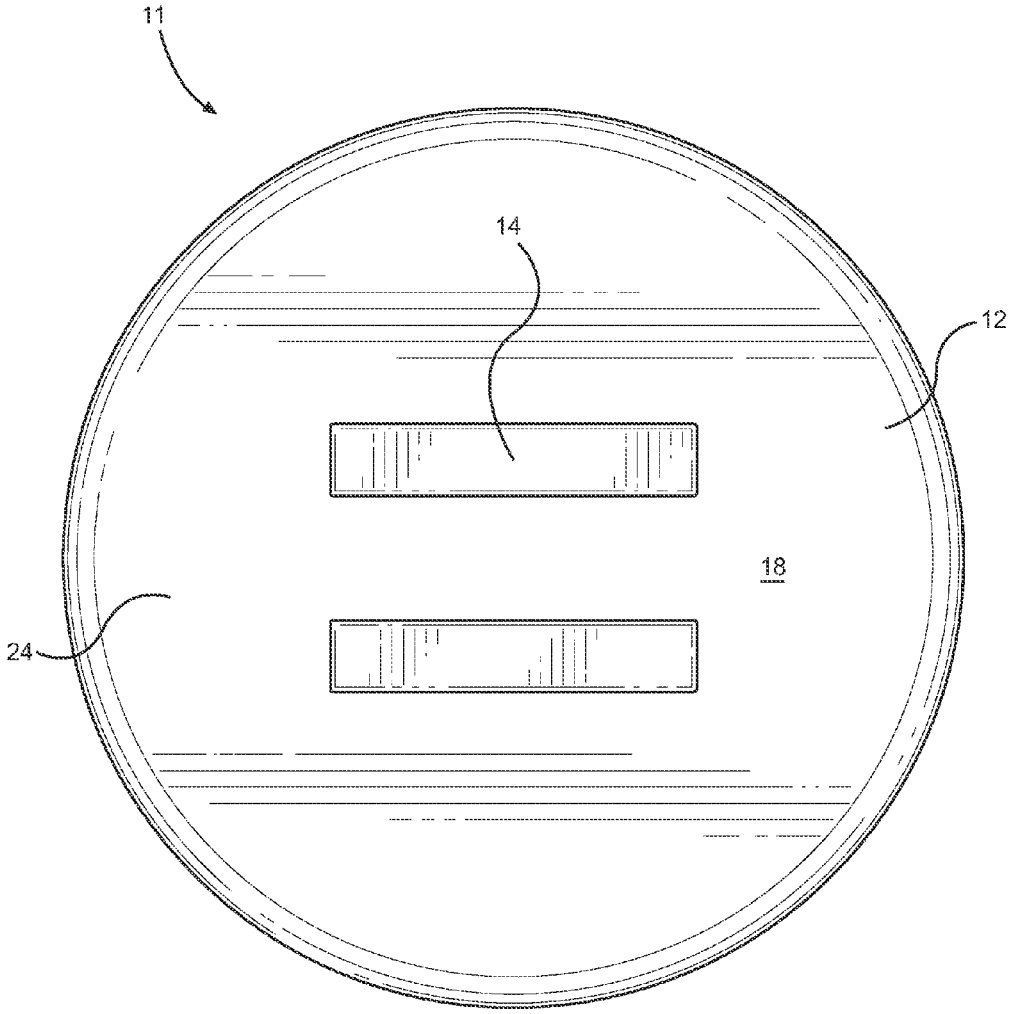
FIG. 3 shows a top down view of the rail mounted table device.

Referring now to FIG. 3, there is shown a top down view of the rail mounted table device. The device 11 further includes a pair of protrusions 13 extending perpendicularly from the lower surface 18 of the planar member 12. The protrusions 13 define a channel 24 therebetween adapted to accept a horizontal rail, allowing the lower surface 18 of the planar member 12 to rest flush against the upper surface of a rail. The channel 24 between the first protrusion 13 and the second protrusion 13 are adapted to equal the width of a rail, thereby allowing the device 11 to fit securely to the rail when placed thereon. The first protrusion 13 is substantially identical to the second protrusion 13. The protrusions 13 are preferably rectangular, wherein the first protrusion 13 is parallel to the second protrusion 13. In this way, the rail mounted table device 11 is adapted to removably secure to a rail. Furthermore, the interior surfaces 21 of the protrusions 13 are shaped so that they rest flush against the vertical sides of the horizontal rail on which the device 11 is supported.

Other embodiments of the rail mounted table device 11 comprise a pair of protrusions 13 having different designs, orientations, and arrangements in order to accommodate rails having different geometries. In some embodiments, the protrusions 13 can be any suitable shape, such as semicircles or pegs, so long as the protrusions 13 permit the planar member 12 to remain horizontal and the interior surface 21 of the protrusions 13 are adapted to removably secure the device 11 to the rail. The protrusions 13 are secured to the lower surface of the planar member 12 by any suitable fastener, such as adhesive or screws. In other embodiments, the protrusions 13 are integral to the planar member 12.

Figure 4:
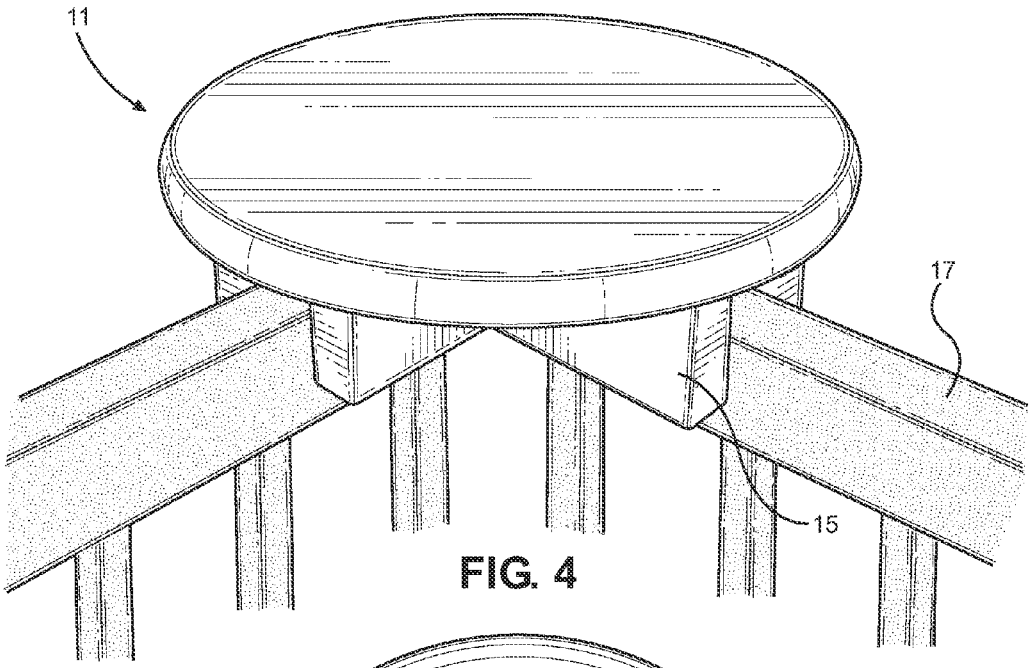
FIG. 4 shows a perspective view of an alternative embodiment of the rail mounted table device.
Figure 5:
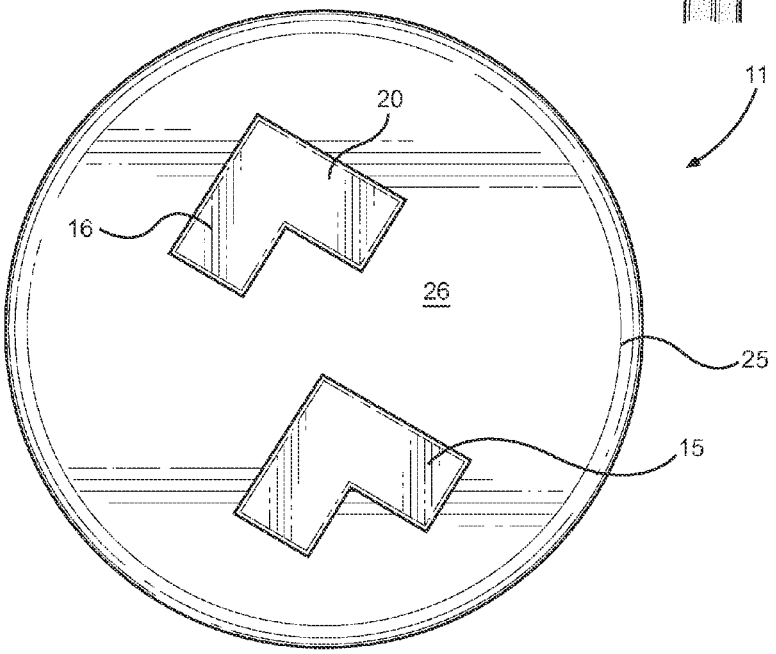
FIG. 5 shows a top down view of an alternative embodiment of the rail mounted table device.

Referring now to FIGS. 4 and 5, there is shown a perspective view of an alternative embodiment of the rail mounted table device and a top down view of an alternative embodiment of the rail mounted table device, respectively. In an alternative embodiment of the rail mounted table device 11, the protrusions 15 extending from the lower surface 26 of the planar member 25 are L-shaped and adapted to accept the corner of a rail 17 therebetween. In the illustrated embodiment, each L-shaped protrusion 15 comprises a ninety degree angle, wherein a first member 16 extends perpendicularly from a second member 20. The first member 16 and second member 20 comprise one piece in the illustrated embodiment. The first member 16 of an L-shaped protrusion 15 is parallel to the corresponding first member 16 disposed on the other L-shaped protrusion 15. The second member 20 disposed on an L-shaped protrusion 15 is parallel to the corresponding second member 20 on the second L-shaped protrusion 15.

In operation, the device removably attaches to a rail. The rail mounted table device is positioned over the top of a horizontal rail, wherein the first protrusion is flush against one vertical side of the rail and the second protrusion is flush against the opposing vertical side of the rail. In this way, the lower surface of the planar member is flush against the upper end of the rail. The upper surface of the planar member is adapted to hold objects thereon, such as food and drinks.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rail mounted table device, comprising:

a planar member having an upper surface and a lower surface;

a first protrusion and a second protrusion each fixedly attached to said lower surface of said planar member adapted to removably secure said planar member to a horizontal support surface, such as a rail;

wherein said first protrusion and said second protrusion define an L-shaped channel therebetween;

wherein said first is protrusion is parallel to said second protrusion, wherein said first protrusion and said second protrusion each extend perpendicularly from said lower surface of said planar member;

wherein said first protrusion and said second protrusion are L-shaped and configured to be removably secured to a corner of said rail.

2. The rail mounted table device of claim 1, wherein said planar member is circular.

3. The rail mounted table device of claim 1, wherein said planar member comprises rounded edges.

4. The rail mounted table device of claim 1, wherein said planar member is provided with a layer of coating adapted to protect said planar member from damage from precipitation.

5. The rail mounted table device of claim 1, wherein said planar member comprises one or more recessed areas on said upper surface adapted to provide a holder for a drink or food.

6. The rail mounted table device of claim 5, wherein said one or more recessed areas is circular in shape.

7. The rail mounted table device of claim 1, wherein said first protrusion and said second protrusion are fixed in position relative to said planar member.

* * * * *